US009538782B2

(12) United States Patent
Kobal et al.

(10) Patent No.: US 9,538,782 B2
(45) Date of Patent: Jan. 10, 2017

(54) INHIBITION OF SENSORY IRRITATION DURING CONSUMPTION OF SMOKELESS TOBACCO PRODUCTS USING A COMBINATORIAL APPROACH

(71) Applicant: Altria Client Services LLC, Richmond, VA (US)

(72) Inventors: Gerd Kobal, Sandy Hook, VA (US); Douglas Oliveri, Powhatan, VA (US); Peter Reeh, Erlangen (DE); Maria Gogova, Richmond, CA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 14/206,734

(22) Filed: Mar. 12, 2014

(65) Prior Publication Data

US 2014/0261485 A1 Sep. 18, 2014

Related U.S. Application Data

(60) Provisional application No. 61/794,711, filed on Mar. 15, 2013.

(51) Int. Cl.

| | |
|---|---|
| ***A24B 15/30*** | (2006.01) |
| ***A24B 15/40*** | (2006.01) |
| ***A24B 15/34*** | (2006.01) |
| ***A24B 15/32*** | (2006.01) |
| ***A24B 13/00*** | (2006.01) |
| ***A24B 15/24*** | (2006.01) |

(52) U.S. Cl.

CPC ..... *A24B 15/30* (2013.01); *A24B 13/00* (2013.01); *A24B 15/24* (2013.01); *A24B 15/301* (2013.01); *A24B 15/303* (2013.01); *A24B 15/32* (2013.01); *A24B 15/34* (2013.01); *A24B 15/403* (2013.01)

(58) Field of Classification Search

USPC ..... 131/310, 290, 352, 300, 347, 366

See application file for complete search history.

(56) References Cited

U.S. PATENT DOCUMENTS

| | | | | |
|---|---|---|---|---|
| 2006/0237024 | A1* | 10/2006 | Reich et al. | 131/270 |
| 2008/0202533 | A1 | 8/2008 | Mishra et al. | |
| 2009/0038631 | A1 | 2/2009 | Mishra et al. | |
| 2011/0178181 | A1 | 7/2011 | Bakes et al. | |
| 2012/0024301 | A1 | 2/2012 | Carroll et al. | |
| 2012/0052021 | A1* | 3/2012 | Kobal et al. | 424/48 |
| 2012/0087981 | A1 | 4/2012 | Wang et al. | |
| 2012/0247492 | A1 | 10/2012 | Kobal et al. | |
| 2013/0045183 | A1 | 2/2013 | Gokaraju et al. | |

FOREIGN PATENT DOCUMENTS

| | | |
|---|---|---|
| WO | WO 2008/079898 | 7/2008 |
| WO | WO 2009/061152 A2 * | 5/2009 |
| WO | WO 2011/046423 | 4/2011 |
| WO | WO 2011/117740 | 9/2011 |

OTHER PUBLICATIONS

Kichko et al., *Irritant? Induced CGRP Release from the Isolated Mouse Trachea and Role of TRP Channels*, 189 (Supplement 653), Acta Physiologica, abstract, (2007).

Yeon et al., *Curcumin Produces an Antihyperalgesic Effect via Antagonism of TRPV1*, 89(2) J. Dent. Res. 170-174 (2010).

International Search Report dated Jun. 26, 2014, in PCT/US2014/025818.

* cited by examiner

*Primary Examiner* — Dennis Cordray

(74) *Attorney, Agent, or Firm* — Buchanan Ingersoll & Rooney PC

(57) ABSTRACT

Combinations of compounds utilized to minimize the sensory irritating character of non-smokeable tobacco products or non-smokeable products containing tobacco extracts or materials derived from tobacco.

18 Claims, No Drawings

INHIBITION OF SENSORY IRRITATION DURING CONSUMPTION OF SMOKELESS TOBACCO PRODUCTS USING A COMBINATORIAL APPROACH

CROSS-REFERENCE TO RELATED APPLICATIONS

This application claims priority to U.S. Provisional Patent Application Ser. No. 61/794,711, filed on Mar. 15, 2013, which is incorporated herein by reference in its entirety for all purposes.

BACKGROUND

Smokeless tobacco is tobacco that is placed in the mouth and not combusted. There generally are considered to be three types of smokeless tobacco: chewing tobacco, moist smokeless tobacco, and dry snuff. Chewing tobacco is coarsely divided tobacco leaf that is typically packaged in a large pouch and used in a plug or twist. Moist smokeless tobacco is moist, more finely divided tobacco that is provided in loose form or in a pouch form and is typically placed between the cheek and gum. Dry snuff is finely ground tobacco is used nasally or is placed in the mouth loose or as a component in a portioned product. Smokeless tobacco may be associated with sensory irritation. Thus, a need exists in the art for newly designed smokeless tobacco products that reduce or eliminate the sensory irritation experienced during consumption.

SUMMARY

Inhibition of sensory irritation during consumption of smokeless tobacco products or smokeless products containing tobacco extracts or materials derived therefrom using a combinatorial approach is provided.

Provided are oral tobacco products comprising a smokeless tobacco product selected from the list consisting of chewing tobacco, moist smokeless tobacco and dry snuff; and at least two active ingredients, wherein the first and second active ingredients are inhibitors of at least one receptor selected from the list consisting of nicotinic acetylcholine receptors and TRP channels. The smokeless tobacco product may be a pouch or portioned product. The active ingredients may be camphor, mercaptan, borneol, isoborneol, bornyl acetate, isobornyl acetate, mono-bornyl succinate, mono-isobornyl succinate, mono-bornyl formate, mono-isobornyl formate, grifolin, neogrifol, albaconol, thapsigargin, yohimbine, synthetic derivatives of resiniferotoxin, curcumin, analogues of 6-gingerol, tetrahydronapthols, and/or derivatives and/or combinations thereof.

Also provided are oral tobacco products comprising a smokeless tobacco product and at least two active ingredients, wherein the at least two active ingredients are present in an amount effective to reduce or eliminate sensory irritation arising from smokeless tobacco. The smokeless tobacco product may be at least partially enclosed by a coating and the coating may contain at least one active ingredient. The smokeless tobacco product may be a pouch product comprising an inner filling material comprising tobacco. The smokeless tobacco product may include an additive, such as flavorants, preservatives, binder, pH stabilizers, disintegrating agents, cross-linking agents, botanical material, vegetable fibers, sweeteners, humectants, and combinations thereof. At least one of the at least two active ingredients may be encapsulated in cyclodextrin.

Also provided are methods of making tobacco products comprising combining a smokeless tobacco product with at least two active ingredients each of which is an antagonist of at least one receptor selected from the list consisting of nicotinic acetylcholine receptors, TRPV1 channels, and TRPA1 channels, wherein the at least two active ingredients are present in an amount effective to reduce or eliminate sensory irritation arising during use of the product.

DETAILED DESCRIPTION

Oral products include smokeless tobacco products such as pouched tobacco and other forms of pre-portioned tobacco, described below. Products containing a chemical irritant (e.g., an agonist of nicotinic acetylcholine receptors or of transient receptor protein channels such as the TRPV1 and/or TRPA1 channels) may cause undesirable sensory irritation and other undesired effects such as nausea in the absence of active ingredients as described herein.

Nicotinic acetylcholine receptors and TRP channels are located on a variety of nerve endings in the peripheral nervous system and play a role in transmission of sensations of irritation (e.g., burning) to the brain. As a result of activation of these receptors, consumers of some products (such as smokeless tobacco) sometimes experience irritation of the mouth, throat, esophagus, stomach, larynx, trachea, etc. when using a non-smokeable tobacco product. Nicotine and other agonists dissolve in the saliva, activate nicotinic acetylcholine receptors and/or sensitize TRP channels, and thereby produce the undesired sensation when they contact the mucosa of the gastro-intestinal tract and parts of the respiratory tract.

By adding antagonists of such sensory receptors into a tobacco product, the perception of sensory irritation associated with consumption of that tobacco product may be reduced or eliminated. The combination of active ingredients described herein preferably serve to reduce or eliminate sensory irritation arising from chemical irritants in consumable products in tobacco and tobacco extracts.

Nicotine, for example, is an agonist of the nicotinic acetylcholine receptors, and can produce the sensory irritation, such as burning or stinging, in the mouth or throat, as well as the gastrointestinal discomfort sometimes associated with smokeless tobacco products. Compounds such as camphor can effectively inhibit activation of sensory nerve fibers induced by nicotine in an isolated mouse trachea model (Kichco et al., 189 (Sup 653) Acta Physiologica (2007)). In studies with human subjects, camphor added to pouches of smokeless tobacco, for example, reduced the sensation of burning at the pouch location as well as along the path of saliva that had been in contact with the pouch.

The addition of camphor to smokeless tobacco can reduce the sensation of burning at the product location as well as along the path of saliva that had been in contact with the product. Moreover, camphor can reduce undesirable and unpleasant sensations in the esophagus as well as nausea and hiccups arising from use of the smokeless tobacco product. However, camphor can also activate the TRPV1 channel and inhibit the nicotinic acetylcholine receptor. The addition of camphor alone may produce some unwanted sensory irritation through the TRPV1 pathway, while providing some desirable effects through the nicotinic acetylcholine receptors. By combining at least two active agents into a smokeless tobacco product, one can overcome sensory irritation mediated through multiple receptors.

Depending upon sample matrixes, concentrations, and other variables, many compounds have been shown to activate or inhibit multiple sensory receptors. To counter the concomitant sensory irritation effects of compounds such as camphor, combination formulas are used. In one embodiment, camphor is used in combination with an inhibitor of the TRPV1 sensory channel. (Yeon et al., Curcumin Produces an Antihyperalgesic Effect via Antagonism of TRPV1, J. Dent. Res. 2010; 89(2): 170-174.). In another embodiment, camphor and curcumin are utilized in combination in a smokeless tobacco product to inhibit the sensory irritation experienced during consumption.

Denfinitions

As used herein, the term "portion" denotes an amount of a product that would typically be used by a consumer as an individual serving and/or dose. For example, a portion refers to a single pouch, lozenge, strip, bit and/or other individual serving.

As used herein, the term "about" when used in conjunction with a stated numerical value or range denotes somewhat more or somewhat less than the stated value or range, to within a range of ±10% of that stated.

As used herein, the singular form "a," "an," and "the" include plural references unless the context clearly dictates otherwise. For example, the term "a cell" includes a plurality of cells, including mixtures thereof.

As used herein, the terms "particle" or "particles" denote any subdivided form of plant material (such as tobacco), and can include flakes, granules, powders, chopped stems, leaves, flowers, or other pieces, as well as extracts and derivatives thereof.

As used herein, the term "smokeless tobacco" denotes tobacco that is placed in the mouth and not combusted and includes chewing tobacco, moist smokeless tobacco, and dry snuff.

As used herein, the term "sensory irritation" includes itching, burning, and the like.

Active Ingredients

The present application is directed to a combinatorial approach to inhibiting sensory irritation during consumption of non-smokeable, i.e., smokeless, tobacco products.

Active ingredients appropriate for use in the smokeless tobacco product of the present application may also be selected based on their ability to act on various transient receptor potential (TRP) ion channels and/or nicotinic acetylcholine receptors. In one embodiment, the smokeless tobacco product includes at least two active ingredients. In another embodiment, at least one of the two active ingredients is capable of inhibiting the TRPV1 channel. In a further embodiment, at least one of the two active ingredients is an active ingredient that inhibits the TRPA1 channel. In yet another embodiment, at least one of the two active ingredients is an active ingredient that inhibits nicotinic acetylcholine receptors. It will be understood that combinations appropriate for use in the present application may include more than two active ingredients. For example, one embodiment appropriate for use herein includes a combination of at least three active ingredients added to the smokeless tobacco product.

It will be further understood by those skilled in the art that active ingredients appropriate for use in the present smokeless tobacco product may function as antagonists to one or more receptors and/or channels and agonists to one or more receptors and/or channels. Compounds known to activate the TRPV1 channel were applied to human tissue culture cells expressing the TRPV1 sensory channel either coincident with the application of curcumin or following the application of curcumin by 5 minutes. Camphor and capsaicin are both known activators of the TRPV1 channel. However, these two compounds activate the sensory channel by different mechanisms. Curcumin, on the other hand, is a potent antagonist of the TPRV1 sensory channel. When capasaicin or camphor were added to cells expressing the TRPV1 sensory channel with curcumin, TRPV1 sensory activation was inhibited. When the combination of curcumin and a TRPV1 activating compound were provided to human test subjects, similar results were observed.

Thus, a combination of an antagonist of sensory irritation perceived through the nicotinic acetylcholine receptor, such as camphor, and an antagonist of sensory irritation perceived through the TRPV1 channel, such as curcumin, can produce complementary effects reducing the sensory irritation associated with tobacco products.

Additional non-limiting examples of active ingredients appropriate for use herein include borneol, isoborneol, bornyl acetate, isobornyl acetate, mono-bornyl succinate, mono-isobornyl succinate, mono-bornylformate, mono-isobornyl formate, grifolin, neogrifol, albaconol, thapsigargin, yohimbine, synthetic derivatives of resiniferotoxin, curcumin, analogues of 6-gingerol, tetrahydro-napthols, and/or derivatives and/or combinations thereof.

Active ingredients for use in the present application may be obtained in various commercially available forms. In one embodiment, the active ingredients are obtained in a powder form. When obtained in a powder form, the active ingredients may be combined, separately or collectively, in a non-flavored oily carrier or other solution prior to being added to a smokeless tobacco product or to a non-smokeable product containing tobacco extracts or materials derived from tobacco.

Compositions of the present application may contain at least two active ingredients. When a nicotinic acetylcholine receptor antagonist is used, it may be included in an amount ranging from about 0.01% to about 10% by weight based on the weight of the composition as determined on a per serving basis (e.g., about 0.05% to about 7.5%, about 0.1% to about 5%, about 0.5% to about 2.5%, about 1% to about 4%). When a TRPV1 channel antagonist is used, it may be included in an amount ranging from about 0.01% to about 10% by weight based on the weight of the composition as determined on a per serving basis (e.g., about 0.05% to about 7.5%, about 0.1% to about 5%, about 0.5% to about 2.5%, about 1% to about 4%). When a TRPA1 channel antagonist is used, it may be included in an amount ranging from about 0.01% to about 10% by weight based on the weight of the composition as determined on a per serving basis (e.g., about 0.05% to about 7.5%, about 0.1% to about 5%, about 0.5% to about 2.5%, about 1% to about 4%).

The multiple active ingredients may be present in various ratios relative to each other, including about 1:1, about 2:1, about 3:1, about 4:1, about 5:1 and greater. For example, a nicotinic acetylcholine receptor antagonist may be present in a 1:1 molar ratio relative to a second antagonist. In one embodiment it may be preferable to include a greater quantity of one antagonist relative to the other. For example, a nicotinic acetylcholine receptor antagonist may be present in up to about a 5:1 molar ratio with a second antagonist (e.g., up to about a 4:1 ratio, up to about a 3:1 ratio, up to about a 2:1 ratio). In one embodiment, the TRPV1 channel antagonist may be present in up to about a 5:1 molar ratio with a second antagonist (e.g., up to about a 4:1 ratio, up to about a 3:1 ratio, up to about a 2:1 ratio). In one embodiment, the TRPA1 channel antagonist may be present in up to about a 5:1 molar ratio with a second antagonist (e.g., up to about a 4:1 ratio, up to about a 3:1 ratio, up to about a 2:1 ratio).

When camphor is used as one of the at least two active ingredients it is preferable to supply an amount of camphor less than that contained in 2 ml of 200 ppm solution (i.e., less than about 400 nanograms). This amount can be increased if the camphor is provided in a form that supplies sustained release, such as an encapsulated form as described below. Thus, in order to achieve reduced or eliminated burning and other sensory irritation arising from nicotine while reducing or eliminating irritation caused from the camphor itself, an orally-enjoyable tobacco product preferably provides about 500 picograms to about 4 milligrams of camphor in each individual application or serving (e.g., in the case of pouched products, in each pouch). More preferably, the amount is about 500 picograms to about 400 nanograms. Even more preferably, the product contains about 2 nanograms to about 20 nanograms of camphor, or about 10 nanograms to about 15 nanograms.

Nicotine

As described herein, products of the present application are contemplated to include nicotine and/or other sensory irritants found in tobacco-containing products. Nicotine, a chemical found in tobacco, produces effects in the body through the activation of neuronal nicotinic acetylcholine receptors. Nicotinic acetylcholine receptors are located on a variety of nerve endings in the peripheral nervous system and play a role in transmission of various sensations to the brain. For example and particularly relevant here, nicotinic acetylcholine receptors may signal a sense of irritation or burning to the brain. Nicotinic acetylcholine receptors are subdivided into two separate classes: N1 and N2. N1 receptors are located at the neuromuscular junction. N2 receptors play a key role in the transmission of cholinergic signals in the autonomic nervous system. These receptors can be found at the autonomic ganglia, the central nervous system and the adrenal medulla. Nicotinic acetylcholine receptors are further subdivided according to the composition of their subunits. In humans, the subunits of nicotinic receptors belong to a 16 gene family.

Nicotine binds to nicotinic acetylcholine receptors, and subsequently triggers the release of neurotransmitters that produce psychoactive effects. In one embodiment, the smokeless tobacco product contains an active ingredient, such as camphor, that when provided at sufficient concentrations, it will target the central nervous system to inhibit acetylcholine receptor activation by nicotine.

Nicotinic acetylcholine receptors exist in various conformational states. Agonists may bind to stabilize an open state. However, acetylcholine receptors can sometimes open with only one bound agonist and, even less frequently, with no agonist bound. Antagonists are also known to bind nicotinic acetylcholine receptors to inhibit their activity. Antagonists may be competitive inhibitors or non-competitive inhibitors. In one embodiment, the smokeless tobacco product contains an active ingredient that acts as an antagonist that acts as a non-competitive inhibitor. In another embodiment, the active ingredient is camphor, which functions as a non-competitive inhibitor of nicotinic acetylcholine receptors in the central nervous system without having a significant impact on nicotine binding.

As described herein, portions of smokeless tobacco include both pouched tobacco and portions that are preferably free of a fabric and/or paper wrapper and comprise tobacco that has been manufactured, molded or divided into individual servings prior to use, such that the portioned tobacco can be placed in a mouth of a consumer without the need for the consumer to determine an amount to use. Forms of pre-portioned tobacco are described in, for example, commonly-assigned U.S. Patent Publication Nos. 2009/0038631, 2008/0202533, and 2009/0301505; and U.S. patent application Ser. Nos. 10/982,248, 11/626,176, 61/588,873, and 61/720,852, each of which is incorporated herein by reference in its entirety.

In one embodiment, the smokeless tobacco is in the form of a pouch. The addition of combined active ingredients to pouches of smokeless tobacco can reduce the sensation of burning at the pouch location as well as along the path of saliva that had been in contact with the pouch. Moreover, combinations of active ingredients can reduce undesirable sensations in the esophagus as well as nausea and hiccups arising from use of the smokeless tobacco pouches.

Preferably, the portion has a generally rectangular or elliptical shape. Other preferred shapes for the pouch include any shape selected from the group consisting of polygons, squares, rectangles, circles, ovals, heart, star, half-moon, crescent, shield, leaf shapes, and combinations thereof.

In another embodiment, the portion is sized and configured to fit inside the mouth, between a consumer's cheek and gum. Preferably, the pouch takes a generally rectangular shape and is about 20 mm to about 35 mm long, about 10 mm to about 20 mm wide and about 3 mm to about 6 mm thick. The corners of the portion may be preferably rounded.

Preferably, the oral tobacco pouch product weighs about 0.1 g to about 5.0 g. These ranges for weight can be further restricted to (a) about 0.1 g to about 1.0 g, (b) about 1.0 g to about 2.0 g, (c) about 2.0 g to about 3.0 g, (d) about 3.0 g to about 4.0 g or (e) about 4.0 g to about 5.0 g. Also preferably, the oral tobacco pouch product 10 is 10 mm to about 20 mm in width, about 20 mm to about 40 mm in length, and about 5 mm to about 20 mm thick.

In one embodiment, the inner filling material (for example, tobacco, possibly together with optional ingredients such as one or more flavorings, sweeteners, humectants, etc.) completely fills the interior of the pouch wrapper. In another embodiment, the inner filling material partially fills the interior of the pouch wrapper.

Preferably, the oral pouch product is sized and configured to fit comfortably in a consumer's mouth. Preferably, the oral pouch product delivers a plurality of flavor and/or functional ingredients to the consumer for a period of about one minute to about 1 hour. Preferably, the pouch is discarded after a single use. Preferably, the pouch contains non-fermented or fermented tobacco.

Some embodiments of a smokeless tobacco system include one or more preformed smokeless tobacco products configured to generally retain their shape during processing, shipping, and consumer handling prior to placement in the mouth. In particular embodiments, each smokeless tobacco product can include a moist smokeless tobacco in combination with a selected binder such that the preformed tobacco portion has improved handling, improved mouth feel, and satisfying flavor profile. Furthermore, some systems described can include a plurality of the smokeless tobacco products packaged into a container where each of the smokeless tobacco products has a substantially similar shape and provides a substantially similar, predetermined portion of tobacco to an adult tobacco consumer. Such a system can permit an adult tobacco consumer to receive consistent portions of tobacco (e.g., with each deposit of a product portion in the mouth) while also experiencing the tactile and flavor benefits of having the smokeless tobacco externally exposed on the article (e.g., not impeded by a paper-like pouch or sachet). Accordingly, some embodiments of the preformed smokeless tobacco product enable an adult tobacco consumer to handle each individual preformed piece from the container without the tobacco portion falling apart prior to placement in the adult tobacco consumer's mouth.

The tobacco, in some embodiments, is moist snuff. The tobacco can have a moisture content of at least 40 weight percent. In certain embodiments, the tobacco can include between 48 and 50 weight percent oven volatiles. The preformed smokeless tobacco products can, in some embodiments, have an oven volatiles content of between 50 and 61 weight percent (e.g., about 57 weight percent oven volatiles). In other embodiments, the tobacco can have a lower moisture content. For example, the total oven volatiles content for a preformed smokeless tobacco product can be between 10 and 30 weight percent.

In an embodiment, a tobacco product has a semi-dissolvable coating, such as a super-hydrated, monolayer membrane, at least partially enclosing a collection of tobacco particles. Such portions preferably do not have a wrapper. The coating is a two-component coating that coats a portion of tobacco material, preferably in a single layer. The two-component coating includes water-soluble, non-cross-linked component and a cross-linked polymer component. The cross-linked polymer is substantially water-insoluble. Optionally, the substantially water-soluble component is a polymer and/or is non-cross-linkable. The tobacco material is preferably a molded portion of moist snuff tobacco. In an embodiment, the coating contains the combination of active ingredients. In yet another embodiment, the coating contains at least one active ingredient. In a further embodiment, the coating contains only one active ingredient, and at least one additional active ingredient is incorporated directly into the smokeless tobacco product.

By controlling the relative amounts of the water-soluble, non-cross-linked component and the cross-linked polymer, the portion can be adapted either to break apart in the consumer's mouth or to remain intact in the consumer's mouth. In the latter case, after the soluble component dissolves in a consumer's mouth, the coating creates a porous network composted of a substantially insoluble polymer.

Accordingly, in an embodiment, the soluble component dissolves rapidly in a consumer's mouth such that the substantially insoluble cross-linked polymer component remains intact throughout use of the tobacco product, so that the coating allows the tobacco juices and flavors to leach out of the coating, while still remaining intact to hold the tobacco within the coating through the duration of tobacco use while providing a soft compliant feel to the tongue and mouth tissues. Because in this embodiment the coating acts to contain the tobacco while it is in the consumer's mouth, when the consumer desires to remove the portion from the mouth, this can be easily accomplished.

In another embodiment, the tobacco material is completely disintegrable so that once the soluble component of the coating dissolves and tobacco material has disintegrated, a consumer may chew and either spit out or ingest the remaining insoluble component. The coating desirably contains a minority amount of the substantially water-insoluble, cross-linked polymer, which minority amount is insufficient for the pre-portion to retain its structural integrity in the consumer's mouth after the water-soluble, non-cross-linked component has dissolved. Thus, the particles of tobacco contained within the coating are released and/or dispersed in the consumer's mouth once the water-soluble component dissolves and the pre-portioned form disintegrates.

Such portions can be prepared by forming portions of tobacco particles into units of a pre-portioned tobacco material; contacting the units of pre-portioned tobacco material with a multi-component aqueous coating solution comprising a water-soluble, non-cross-linked component and a cross-linkable polymer which forms a substantially water-insoluble polymer upon cross-linking, to form coatings on the units of pre-portioned tobacco material; cross-linking the cross-linkable polymer to form portions of smokeless tobacco comprising the units of pre-portioned tobacco material with a semi-dissolvable coating on the surface thereof.

In one embodiment, a coating is prepared from a multi-component polymer solution (coating solution). The pre-portioned amount of moist tobacco can be enclosed by the coating by applying to at least some of the outer surface of the portion a polymer solution including at least two components. At least one component of the coating solution is a water-soluble, non-cross-linkable component, which dissolves in the mouth. At least one other component in the coating solution is a water-soluble, cross-linkable polymer which becomes substantially water-insoluble after cross-linking. The coating may be applied to the moist pre-portioned tobacco by a variety of techniques, which can include dipping, spraying, and the like. The coated pre-portioned tobacco is then contacted with a cross-linking agent suitable for the cross-linkable polymer or polymers employed in the coating. This contact can result from application of the cross-linking agent to the coated portion, e.g., by spraying, dipping, or other application of a solution of cross-linking agent to the coated portion (resulting in an "outside-in" direction of cross-linking). Alternatively, cross-linking can result from contact of the cross-linkable polymer with cross-linking agent already present in the tobacco, either as the result of cross-linking agent present in the tobacco before it is formed into a pre-portion, or as the result of the application of cross-linking agent to the pre-portion prior to application of the coating.

The coating is preferably in the form of a gel, more particularly in the form of a hydrogel. As a result, a significant portion of the weight of the coating is water, in addition to the water-soluble non-cross-linked component and the substantially water-insoluble cross-linked polymer, as well as cross-linking agents, and any additives, such as preservatives, flavorants, etc. Because only the water-soluble, non-cross-linked component of the coating dissolves and releases moisture into the consumer's mouth, the amount of moisture released is controlled, and is not excessive. This provides the consumer with decreased slipperiness and improved mouthfeel when using the product.

Preferably, the water-soluble, non-cross-linked component dissolves rapidly in a consumer's mouth. In another embodiment, the soluble component dissolves in about 0.1 seconds to about 10 seconds (e.g., about 1 second to about 9 seconds, about 2 seconds to about 8 seconds, about 3 seconds to about 7 seconds or about 4 seconds to about 6 seconds) after introduction into the oral cavity. Also preferably, the pre-portioned form loses its structural integrity within about 5 to about 15 seconds (e.g., about 6 to about 14 seconds, about 7 to about 13 seconds, about 6 to about 12 seconds, about 7 to about 11 seconds or about 8 to about 10 seconds) after introduction into the oral cavity.

The water-soluble component and substantially water-insoluble component may be natural or synthetic. Preferably the components are hydrocolloids. More preferably, the components are polysaccharides.

Optionally, the water-soluble component comprises a non-cross-linked and/or non-cross-linkable polymer. In an embodiment, the water-soluble component can be formed by a cross-linkable polymer, which has not reacted with a cross-linking agent. Suitable water-soluble non-cross-linked components include, without limitation, starch and starch derivatives, such as modified starch, dextrin, gums, such as gum arabic, guar gum, xanthan gum, locust bean gum, curdlan gum, gellan gum, fenugreek derivative gums, pullulan, chitosan, chitin, cellulose and cellulose derivatives, synthetic polymers, such as polyvinyl alcohol, polylactide, polyethylene glycol, polyvinylpyrrolidone, or polyvinylacetate, and soluble or insoluble vegetable fiber.

Suitable chemically cross-linkable polymers include, without limitation, alginate, pectin, carrageenan, and modified polysaccharides with cross-linkable functional groups. Preferred cross-linkable polymers are pectins and alginates. Proteins, for example gelatin, zein, soy protein, rice protein, and whey protein, can optionally be used to supplement or replace the cross-linkable polymers that are cross-linked with monovalent and bivalent metal ion salts. The proteins slowly cross-link with phenolics and/or aldehydes that occur naturally in tobacco.

In another embodiment, the cross-linking agent is a polyvalent metal salt, more particularly, a monovalent metal ion salt or bivalent metal ion salt. While, both monovalent and bivalent metal ion salts may be used, a bivalent metal ion salt is particularly suitable for cross-linking certain polysaccharides, such as pectins. Suitable cross-linking agents include, without limitation, calcium lactate, calcium chloride, calcium lactobionate, tricalcium phosphate, calcium glycerophosphate, calcium hexametaphosphate, calcium acetate, calcium carbonate, calcium bicarbonate, calcium citrate, calcium gluconate, sodium chloride, sodium lactate, sodium acetate, sodium carbonate, sodium bicarbonate, sodium citrate, sodium gluconate, potassium chloride, potassium lactate, potassium acetate, potassium carbonate, potassium bicarbonate, potassium citrate, potassium gluconate and combinations of these.

Exemplary tobacco materials can be made of cut or ground tobacco and can include flavorants, additives and/or humectants. Examples of suitable types of tobacco materials that may be used include, but are not limited to, flue-cured tobacco, Burley tobacco, dark fire-cured tobacco, air-cured tobacco, Maryland tobacco, Oriental tobacco, rare tobacco, specialty tobacco, reconstituted tobacco, blends thereof and the like. In a preferred embodiment, the tobacco material is pasteurized. In the alternative, the tobacco may be fermented.

The tobacco material may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, tobacco beads, blends thereof, and the like. Genetically modified tobacco and other treated tobaccos may also be used in the filling material. Also preferably, the tobacco material is smaller than about 20 mesh for ease of pouching.

In a preferred embodiment, in addition to or in lieu of tobacco material, the filling material can also include a supplemental amount of botanical material other than tobacco, such as tea, coffee, herbs, spices, and/or vegetable fibers. Additionally, the tobacco material may also include a supplemental amount of vegetable or plant fibers or particles, such as particles of shreds of lettuce, cotton, flax, beet fiber, cellulosic fibers, blends thereof and the like.

In another embodiment, additives can also be added to the filling material and/or pouch wrapper of the oral tobacco pouch product. Suitable additives include, without limitation, humectants, flavorants, sweeteners, and/or combinations thereof.

In some embodiments, the one or more smokeless tobacco products include at least 0.5 weight percent of binder. The smokeless tobacco products can, in some embodiments, include less than 5.0 weight percent binder. In certain embodiments, the smokeless tobacco products include between 0.5 and 1.5 weight percent binder.

The binder can be a carbohydrate. In some embodiments, the binder includes a hydroxyl containing compound, a dextrin or dextrin derivative, carboxymethyl cellulose, hydroxypropyl cellulose, hydroxyethyl cellulose, hydroxypropyl methyl cellulose, methyl cellulose, konjac, collagen, inulin, soy protein, whey protein, casein, wheat gluten, carrageenan, alginates, propylene glycol alginate, xanthan, dextrin, pullulan, curdlan, gellan, locust bean gum, guar gum, tara gum, gum tragacanth, pectin, agar, zein, karaya, gelatin, psyllium seed, chitin, chitosan, gum acacia, polyvinyl pyrrolidone, polyethylene oxide, polyvinyl alcohol, or a combination thereof. In certain embodiments, the binder is selected from the group of guar gum, xanthan, cellulose, and combinations thereof. For example, the preformed smokeless tobacco products can include between 0.6 and 0.8 weight percent of a binder that includes guar gum, xanthan, and cellulose.

In some embodiments, the preformed smokeless tobacco product can optionally include one or more flavorants. For example, suitable flavorants include wintergreen, cherry and berry type flavorants, various liqueurs and liquors such as Dramboui, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ilangilang, sage, fennel, piment, ginger, anise, coriander, coffee, liquorish, and mint oils from a species of the genus Mentha. Mint oils useful in particular embodiments of the smokeless tobacco product include spearmint and peppermint.

The smokeless tobacco product may optionally include other additives. Other additives include fillers (e.g., starch, di-calcium phosphate, lactose, sorbitol, mannitol, and microcrystalline cellulose), soluble fiber (e.g., Fibersol from Matsushita), calcium carbonate, dicalcium phosphate, calcium sulfate, and clays), lubricants (e.g., lecithin, stearic acid, hydrogenated vegetable oil, mineral oil, polyethylene glycol 4000-6000 (PEG), sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides), plasticizers (e.g., glycerine, propylene glycol, polyethylene glycol, sorbitol, mannitol, triacetin, and 1,3 butane diol), stabilizers (e.g., ascorbic acid and monosterol citrate, BHT, or BHA), artificial sweeteners (e.g., sucralose, saccharin, and aspartame), disintegrating agents (e.g., starch, sodium starch glycolate, cross caramellose, cross linked PVP), pH stabilizers, or other compounds (e.g., vegetable oils, surfactants, and preservatives). Some compounds display functional attributes that fall into more than one of these categories. For example, propylene glycol can act as both a plasticizer and a lubricant and sorbitol can act as both a filler and a plasticizer. Water and other oven volatiles can also be added during a mixing process to alter the total oven volatiles content of the formed smokeless tobacco product. Various salts can also be added.

The type and amount of flavorants and other additives can also impact the material properties of the smokeless tobacco product. In some embodiments, the amount of flavorants and other additives in the preformed smokeless tobacco product are limited to less than 10 weight percent in sum. In some embodiments, the amount of flavorants in the preformed smokeless tobacco product are limited to be less than 5 weight percent in sum. For example, certain flavorants can be included in the preformed smokeless tobacco product in amounts of about 3 weight percent.

In some embodiments, the combination of tobacco, flavorants, and other additives used in the preformed smokeless tobacco product can be the mixture of tobacco, flavorants, and other additives commercially sold as smokeless tobacco. For example, the finished tobacco can be the same as the finished smokeless tobacco sold under the trade name SKOAL (e.g., SKOAL Long Cut), which includes flavorants and other additives.

It is to be understood that, while the systems, products, compositions of matter, and methods have been described herein in conjunction with a number of different embodiments, the foregoing description of the various embodiments is intended to illustrate and not limit the scope of the systems, products, compositions of matter, and methods. Other embodiments, advantages, and modifications are within the scope of the following claims. All cited publications are incorporated by reference herein in their entireties for all purposes.

What is claimed is:

1. A tobacco product comprising:

a smokeless tobacco product selected from the list consisting of chewing tobacco, moist smokeless tobacco and dry snuff;

at least two active ingredients;

wherein the first active ingredient is an antagonist of a nicotinic acetylcholine receptor and the second active ingredient is an antagonist of a TRP ion channel; and wherein the tobacco product does not comprise mercaptan or curcumin.

2. The tobacco product of claim 1, wherein the smokeless tobacco product is a pouch or preformed product.

3. The tobacco product of claim 1, wherein the at least two active ingredients are selected form the list consisting of camphor, borneol, isoborneol, bornyl acetate, isobornyl acetate, mono-bornyl succinate, mono-isobornyl succinate, mono-bornyl formate, mono-isobornyl formate, grifolin, neogrifol, albaconol, thapsigargin, yohimbine, synthetic derivatives of resiniferotoxin, analogues of 6-gingerol, tetrahydro-napthols, and/or derivatives and/or combinations thereof.

4. The tobacco product of claim 3, wherein one of the at least two active ingredients is camphor.

5. The tobacco product of claim 1, wherein the smokeless tobacco product is at least partially enclosed by a coating and wherein the coating contains one of the at least two active ingredients.

6. The tobacco product of claim 5, wherein the coating comprises a multi-component polymer solution and wherein at least one component of the coating solution comprises a water-soluble, non-cross-linkable component.

7. The tobacco product of claim 1, wherein the product further comprises an additive selected from the list consisting of flavorants, preservatives, binder, pH stabilizers, disintegrating agents, cross-linking agents, botanical material, vegetable fibers, sweeteners, humectants, and combinations thereof.

8. The tobacco product of claim 1, further comprising a third active ingredient.

9. The tobacco product of claim 1, wherein the at least two active ingredients are present in an amount of about 500 picograms to about 4 milligrams per portion.

10. The tobacco product of claim 1, wherein at least one of the at least two active ingredients is encapsulated in cyclodextrin.

11. The tobacco product of claim 1, wherein the smokeless tobacco product is a pouch product comprising an inner filling material comprising tobacco.

12. The tobacco product of claim 11, wherein the inner filling material further comprises one of the at least two active ingredients selected from the list consisting of camphor, borneol, isoborneol, bornyl acetate, isobornyl acetate, mono-bornyl succinate, mono-isobornyl succinate, mono-bornyl formate, mono-isobornyl formate, grifolin, neogrifol, albaconol, thapsigargin, yohimbine, synthetic derivatives of resiniferotoxin, analogues of 6-gingerol, tetrahydro-napthols, and/or derivatives and/or combinations thereof.

13. The tobacco product of claim 12, wherein the inner filling material further comprises the at least two active ingredients.

14. A method of making a tobacco product comprising:

combining a smokeless tobacco product with at least a first and second active ingredient;

wherein the first active ingredient is an antagonist of a nicotinic acetylcholine receptor and the second active ingredient is an antagonist of a TRP ion channel;

wherein the first and second active ingredients are present in an amount effective to reduce or eliminate sensory irritation arising during use of the product; and wherein the tobacco product does not comprise mercaptan or curcumin.

15. The method of claim 14, wherein the first and second active ingredients are selected from the list comprising camphor, borneol, isoborneol, bornyl acetate, isobornyl acetate, mono-bornyl succinate, mono-isobornyl succinate, mono-bornyl formate, mono-isobornyl formate, grifolin, neogrifol, albaconol, thapsigargin, yohimbine, synthetic derivatives of resiniferotoxin, analogues of 6-gingerol, tetrahydro-napthols, and/or derivatives and/or combinations thereof.

16. The method of claim 14, further comprising combining the first and second active ingredients with a non-flavored oily carrier prior to being added to the smokeless tobacco product.

17. The method of claim 14, wherein the first active ingredient is camphor.

18. The method of claim 14, wherein the TRP ion channel is selected from the group consisting of a TRPV1 channel and a TRPA1 channel.

* * * * *